United States Patent [19]

Hatt

[11] Patent Number: 5,065,994

[45] Date of Patent: Nov. 19, 1991

[54] NON-LAP OPENER

[75] Inventor: Walter Hatt, Yardley, Pa.

[73] Assignee: Graphic Management Associates, Inc., Mass.

[21] Appl. No.: 654,741

[22] Filed: Feb. 13, 1991

[51] Int. Cl.[5] ..... B65H 5/30

[52] U.S. Cl. ..... 270/55

[58] Field of Search ..... 270/54–58

[56] References Cited

U.S. PATENT DOCUMENTS

| | | | |
|---|---|---|---|
| 3,692,301 | 9/1972 | Wetter | 270/55 |
| 4,373,710 | 2/1983 | Hansen | 270/55 |
| 4,496,141 | 1/1985 | Nayate | 270/55 |
| 4,709,910 | 12/1987 | Honegger | 270/55 |
| 4,723,770 | 2/1988 | Seidel | 270/57 |
| 4,743,005 | 5/1988 | Reist | 270/55 |

FOREIGN PATENT DOCUMENTS

| | | | |
|---|---|---|---|
| 641113 | 2/1984 | Switzerland | 270/55 |

*Primary Examiner*—Edward K. Look
*Assistant Examiner*—Therese M. Newholm
*Attorney, Agent, or Firm*—Jordan B. Bierman

[57] ABSTRACT

A device for separating a printed product into two groups of pages wherein the product is held between two faces of a pocket and an element presses against the fold to cause the product to bow outwardly and form an opening. A preopener is inserted into the opening and moved toward the free edge. Thereafter, grippers hold the corners to prevent curling and an opener moves across the width of the product where the opposite corners are held.

16 Claims, 6 Drawing Sheets

NON-LAP OPENER

The present Application is directed to a device for opening the pages of a printed product, particularly for the purpose of placing inserts in a tabloid newspaper.

BACKGROUND OF THE INVENTION

Devices which receive, convey, and open folded printed products to permit inserts therein have been known for many years. U.S. Pat. No. 4,723,770, the disclosure of which is incorporated herein by reference, is an example of one such device particularly adapted for use in placing inserts into newspapers. The outermost section is received by a generally V-shaped pocket which has one stationary wall and one movable wall. The paper is inserted while the walls are separated, they are then brought together and vacuum applied. The vacuum holds the halves of the paper against the walls (which are then separated); thereby causing the paper to open. Any additional sections can then be easily inserted.

The foregoing device works satisfactorily for full sized newspapers. In this situation, the folded paper has only two unfolded edges; namely, the edge opposite spine or fold, and one open side. However, in the case of tabloids, there is only a single fold at the bottom, and the three other edges are all unfolded. The same is true of booklets.

Such printed products present special problems, especially if the paper is thin and flexible. When the vacuum is applied and the pocket opened to permit insertion, the pages tend to curl downward into the V notch. Thus, on insertion, the pages are crumpled and/or torn. This result is, of course, unsatisfactory from a commerical standpoint.

Moreover, it is often important that separation in the pocket take place with approximately half the pages on either side. Usually only the outermost pages are held against the walls of the pocket and the others will fall loosely. Thus, even if crumpling is avoided, the inserts will be placed between the first two pages, increasing the likelihood of tearing.

BRIEF DESCRIPTION OF THE INVENTION

It is an object of the present invention to provide a novel means for opening a printed product into two approximately equal sections for placement of inserts therein. It is especially useful in the case of tabloids, although it will also work well with broadsheets. It provides a means whereby such printed products can be opened substantially at their centers, and one or more additional sections inserted. This can be preformed at high speed so that even newspapers having multiple sections can easily be produced within the time frames required. The present invention will be described in connection with newspapers, but it is also applicable to other similar printed products.

In essence, the present device comprises a V-shaped pocket, hinged at its lower edge, and adapted to receive the newpaper between its two walls. The walls are pivotable with respect to one another into an abutting closed position and a separated open position. The paper is inserted with the fold adjacent the hinge.

In essence, a pressing element pushes upwardly against the fold causing it to bow outwardly, thereby forming an opening adjacent the fold. A preopener is inserted into the opening, and then moved away from the hinge toward the unfolded edge which is parallel to the fold. In some cases, this is sufficient to cause the entire paper to assume the desired open position, and the additional sections are then inserted.

In a preferred form of the device, a finger is provided which contacts one group of pages adjacent the corner formed by the unfolded edge and the near (unfolded) side. The finger then moves across the width of the paper substantially along the unfolded edge. If desired, gripper can be used to hold the corners against the respective walls of the pocket in order to prevent curling of the pages or any other interference with the intended insertion of additional sections.

DETAILED DESCRIPTION OF THE INVENTION

The device of the present invention includes the aforementioned pocket which is adapted to receive and hold the newspaper therein. It has a first wall and a second wall which are hingedly connected to one another and may move toward each other into the closed position and away from each other into the open position.

One of the inner faces is provided with at least one abutment and the other has a corresponding area against which the abutment may press when the pocket is in the closed position. The newspaper is placed in the pocket while it is in the open position and the pocket is thereafter closed. This causes the paper to be held between the abutment on one inner face and the corresponding abutment area on the other inner face. As a result, the paper is prevented from moving in the direction away from the hinge and the fold. Of course, more than one abutment and abutting area may also be used if desired and, in such a case, the abutments can independently be on either face, as can the abutment areas.

A pressing element exerts pressure against the fold in the direction of the unfolded edge. Since the paper is prevented from movement in the direction by the abutment, the pages separate into two groups at that point, thereby forming an opening adjacent the fold. It is preferred that the abutment be in alignment with the direction of movement of the pressing element, but this is not necessary.

Once the opening is formed, a preopener is moved therein in a direction parallel to the fold. The preopener is then moved substantially perpendicularly to the fold toward the unfolded edge, thereby causing at least the near side of the paper to separate into the two groups of pages. At this point, a finger contacts the corner of the paper formed by the near unfolded sides and the unfolded edges. If necessary, a gripper presses against these corners as the pocket opens in order to prevent the pages from curling downward. The finger moves across the width of the paper until it reaches the corner formed by the unfolded edge and the far side. Here, too, if appropriate, a pair of grippers will press the corners against the inner faces of the pocket, thereby holding the paper affirmatively in its open position so that the desired additional sections can be inserted.

It will be readily understood that, if the newspaper is a broadsheet, the far side is folded. Therefore, there will not be much tendency for the pages to curl downward at that point. Thus, it may very well be sufficient to retain just the near corners against the corresponding inner faces. It is even posssible that, the moving finger can be eliminated as the angle of the pocket and the degree of its opening may be such that there is no real tendency for even the near side pages to curl. However, where a tabloid is concerned, it is of greater importance to secure all four corners by the grippers.

BRIEF DESCRIPTION OF THE DRAWINGS

In the accompanying drawings, constituting a part hereof, and in which like reference characters indicate like parts.

The present device consists of pocket 1 having first wall 3 and second wall 2 connected at hinge 4. Second inner face 15 is provided with abutment 5 and first inner face 16 has corresponding abutment area 20. As is shown in FIG. 2, newspaper 7 is inserted between walls 2 and 3, pocket 1 is brought into its closed position, and abutment 5 presses newspaper 7 against abutment area 20, thereby securing it against movement in the direction of edge 17. FIG. 3 shows pressure element 6 thereafter being brought to bear against fold 21 and, since abutment 5 and abutment area 20 secure paper 7 against movement, opening 8 forms between first group 26 and second group 27. The movement of element 6 is continued and, as shown in FIGS. 4 and 5, preopener 9 is inserted into opening 8 adjacent fold 21. Preopener 8 is then moved upwardly in the direction of edge 17.

Figure 1:
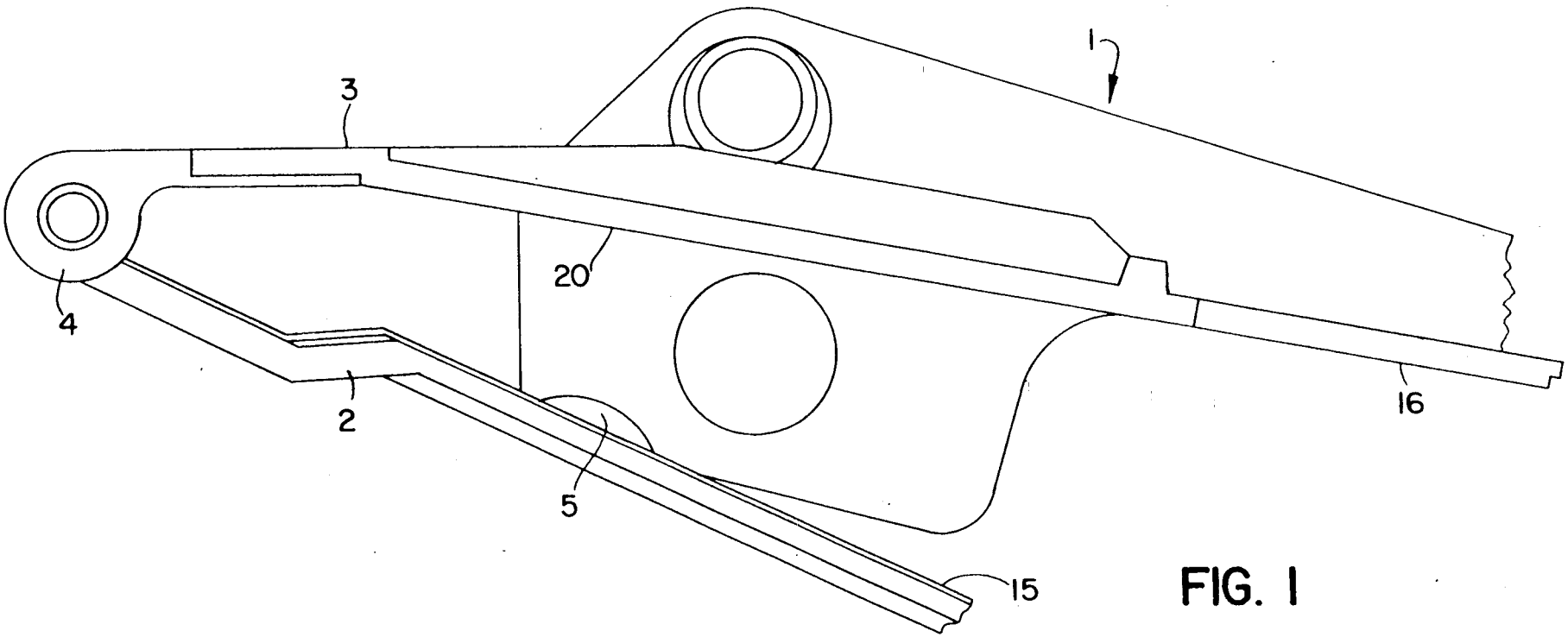
FIG. 1 is a schematic view, taken from the near side, of a pocket before insertion of the newspaper.
Figure 2:
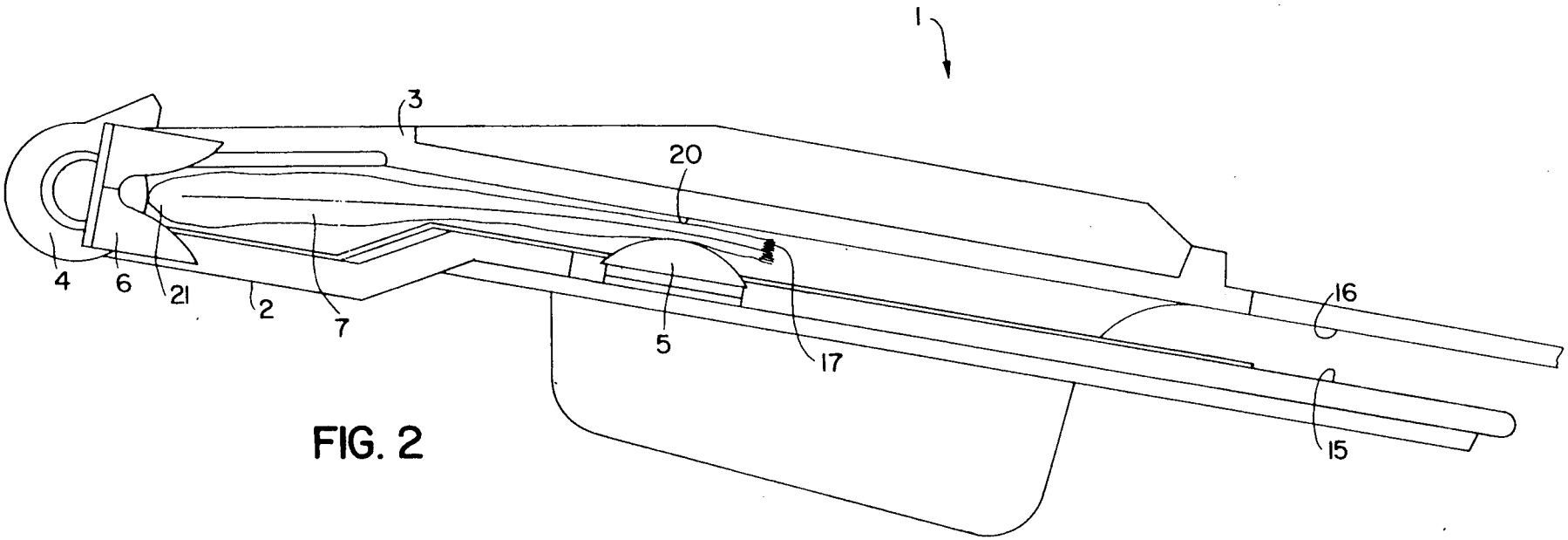
FIG. 2 is a schematic view, similar to that of FIG. 1, after the newspaper has been inserted and the pocket moved to its closed position.
Figure 3:
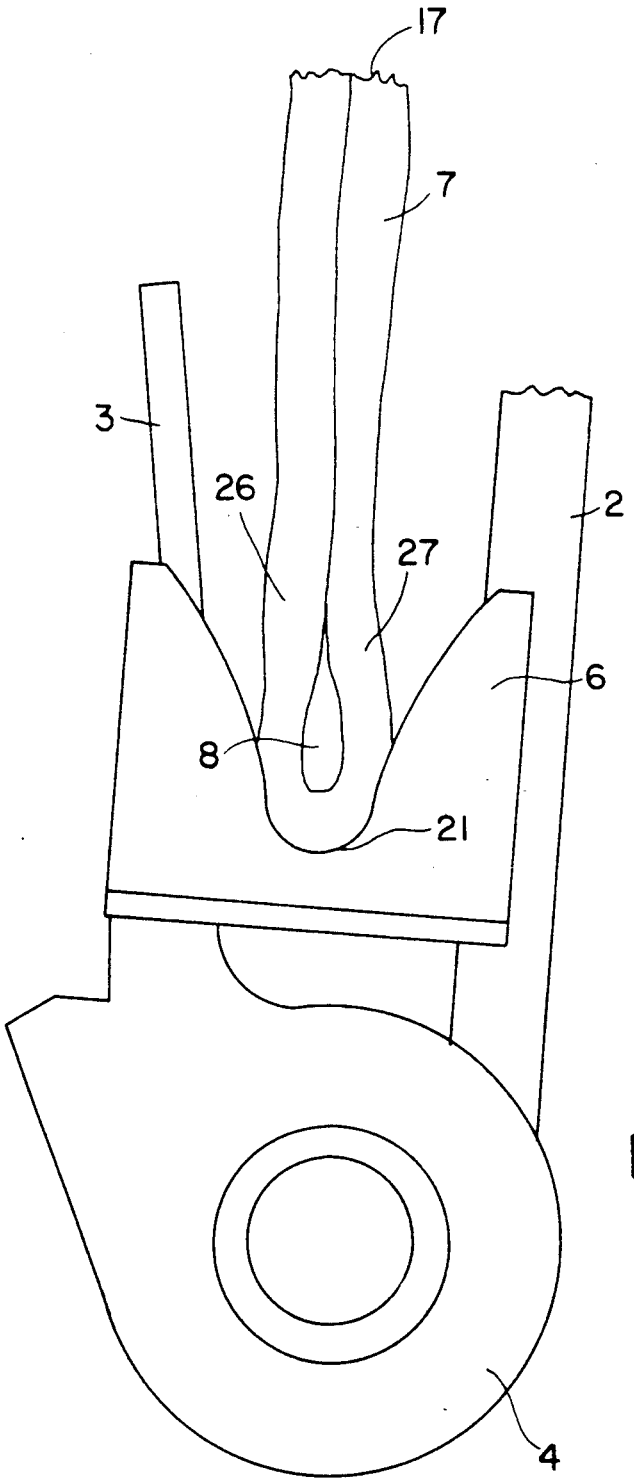
FIG. 3 is an enlarged, fragmentary, schematic view showing the pressing element pushing upwardly against the fold.
Figure 4:
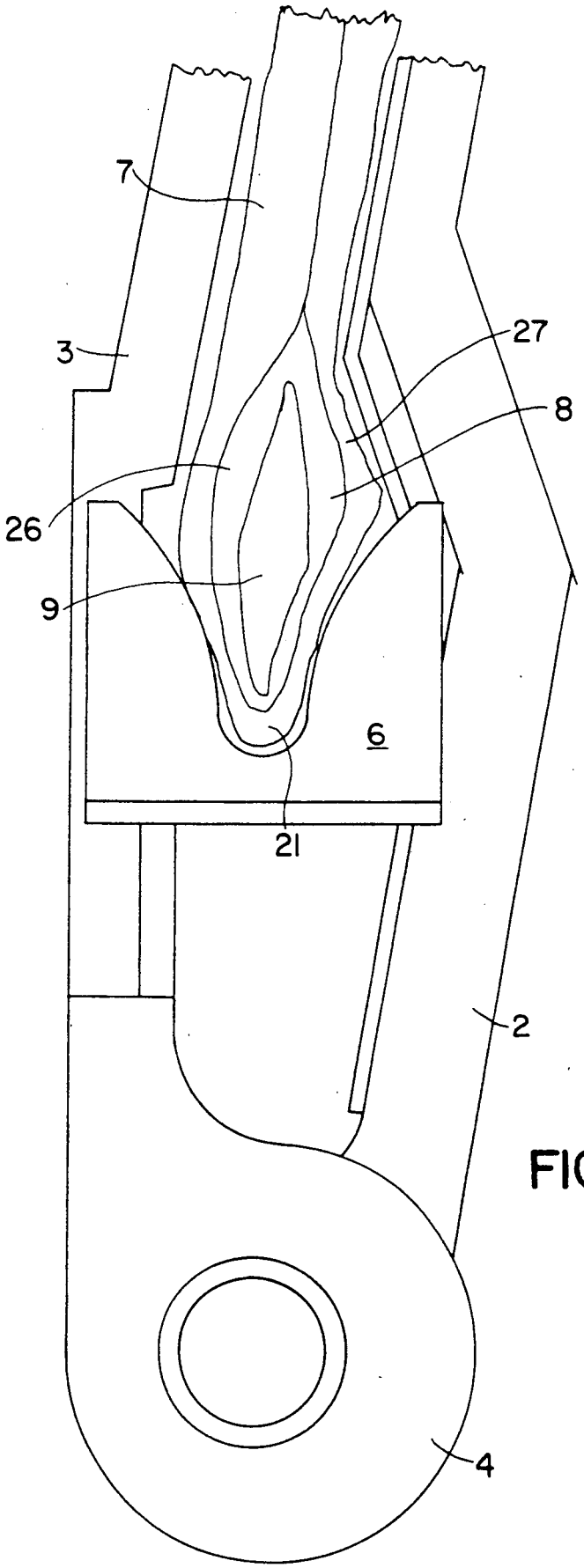
FIG. 4 is an view similar to that of FIG. 3 showing the pressing element at its maximum height position.
Figure 5:
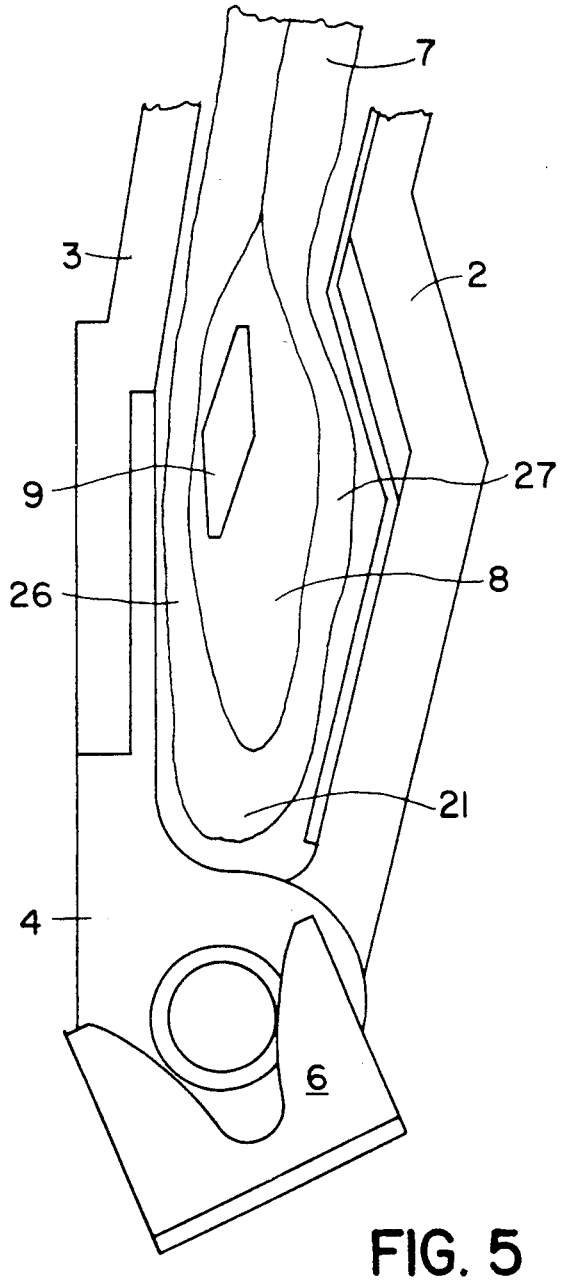
FIG. 5 is a view similar to that of FIG. 4 wherein the preopener is shown inserted into the opening.
Figure 6:
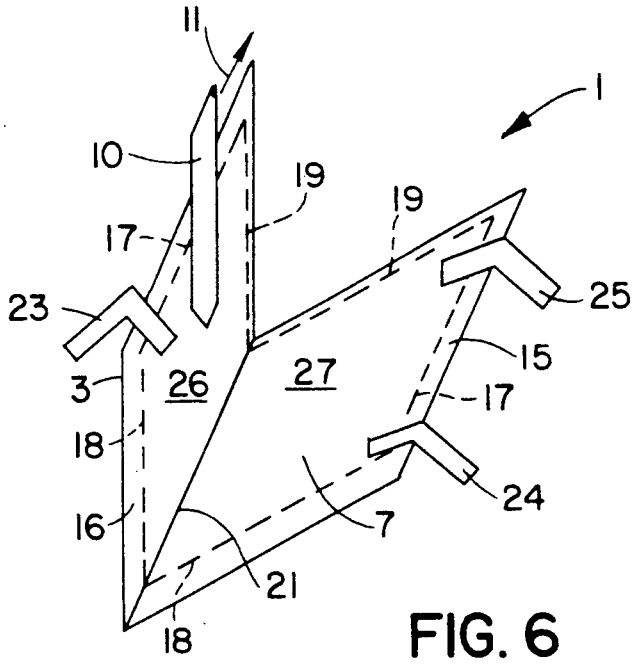
FIG. 6 is a schematic view showing the pocket in its open position after the moving finger has begun to traverse the unfolded edge.

Referring more specifically to FIG. 6, pocket 1 is opened and grippers 23 and 24 are actuated so that they bear against groups 26 and 27 adjacent the corners formed by near sides 18 and edges 17. Finger 10 is inserted adjacent one of the corners and is moved in the direction of arrow 11 toward one of the corners formed by edges 17 and far sides 19.

Gripper 25 secures the corners of second group 27 formed by edge 15 and far side 19 against inner face 15. A similar gripper (not shown), after finger 10 has completed its travel, retains the corner of first group 26 formed by edge 17 and far side 19.

Figure 7:
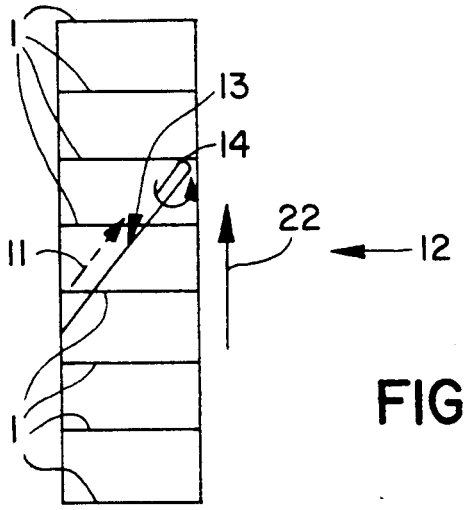
FIG. 7 is a schematic plan view of a line of pockets on a conveyor showing the position of the finger activator.

In FIG. 7 a plurality of pockets 1 is shown schematically. Pockets 1 are conveyed in the direction of arrow 22 and cylinder 13 is mounted at an angle to arrow 22. A plurality of tongues 10 are spirally located on cylinder 13 which rotates in the direction of arrow 14. As pockets 1 are conveyed in the direction of arrow 22 and cylinder 13 rotates in the direction of arrow 14, a succession of tongues 10 enter and leave the gap between group 26 and group 27. In this manner, the original opening 8 is moved across the entire width of paper 7 and the desired insertions can be made.

While only a limited number of specific embodiments of the invention have been expressly disclosed it is, nonetheless, to be broadly construed and not to be limited except by the character of the claims appended hereto.

I claim:

1. A device for opening a printed product which has a fold, an unfolded edge parallel to and spaced apart from said fold, and first and second sides extending between said open edge and said fold, at least one of said first side and said second side being unfolded, (a) said device comprising a pocket for said printed product and having a first wall and a second wall connected by a hinge, said first wall and said second wall pivoted at said hinge for motion toward each other into a closed position and away from each other into an open position, said fold being adjacent said hinge, (b) at least one abutment on a first inner face of said first wall or a second inner face of said second wall, an abutment area on the other of said first wall or said second wall and adjacent said abutment when said pocket is in said closed position, whereby said product is held between said abutment and said area and movement thereof in a first direction away from said hinge is prevented, (c) a pressing element adapted to contact said fold and exert pressure thereon in said first direction, thereby forming an opening adjacent said fold between first and second groups of pages of said product, (d) a preopener, adjacent said first side, adapted for movement into said opening in a second direction parallel to said fold, thereafter moving in said first direction, thereby dividing said groups substantially from said opening to said edge adjacent said first side, (e) an opener, adapted to contact said product, at a first point adjacent said first side and said edge, (f) said opener further adapted for movement in said second direction along said edge to a second point adjacent said second side and said edge, thereby dividing said product into said groups across its entire width.

2. The device of claim 1 wherein said pocket is in said closed position when said pressing element is exerting pressure on said fold.

3. The device of claim 2 wherein said pocket is in said open position when said preopener is moving in said first direction.

4. The device of claim 1 wherein said pocket is one of a plurality thereof which moves in a longitudinal direction, said opener is a plurality of projections mounted on a cylinder which is at an angle other than 0° or 90° to said longitudinal direction, said cylinder rotating at a speed whereby said projections successively move into and out of contact with said product.

5. The device of claim 1 wherein said pocket is one of a plurality thereof which moves in a longitudinal direction, said opener is a helical element projecting radially from a cylinder, said cylinder rotating at a speed whereby successive portions of said helical element move into and out of contact with said product.

6. The device of claim 1 wherein, after (e), said first group is retained between a first gripper and said first wall or said second wall at said first point.

7. The device of claim 6 wherein, after (e), said second group is retained between a second gripper and the other of said first wall or said second wall at said first point.

8. The device of claim 1 wherein said second side is folded.

9. The device of claim 6 wherein, after (f), said first group is retained between a third gripper and said first wall or said second wall at said second point.

10. The device of claim 9 wherein, after (f), said second group is retained between a fourth gripper and the other of said first wall or said second wall at said second point.

11. The device of claim 6 wherein said first group is retained between said first gripper and said first wall and, after (f), said first group is retained between a third gripper and said first wall at said second point.

12. The device of claim 1 wherein said first wall is stationary with respect to said second wall and said second wall is movable with respect to said first wall into said closed position or said open position.

13. The device of claim 11 wherein said pocket is one of a plurality thereof which moves in a longitudinal direction, said first wall being ahead of said second wall in said longitudinal direction.

14. The device of claim 12 wherein a lower portion of said pocket adjacent said hinge is downstream of an upper portion of said pocket in said longitudinal direction.

15. The device of claim 1 wherein said abutment and said abutment area are in line with said pressure in said first direction.

16. The device claim 1 wherein there is a plurality of said abutments and said abutment areas.

* * * * *